US008763708B2

(12) United States Patent
Travis et al.

(10) Patent No.: US 8,763,708 B2
(45) Date of Patent: Jul. 1, 2014

(54) WELLHEAD ROTATING BREECH LOCK AND METHOD

(75) Inventors: Todd Travis, Humble, TX (US); Scott Menard, Houston, TX (US); Brandon M. Cain, Houston, TX (US); Ping Cai, Sugar Land, TX (US); Michael Mosher, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 851 days.

(21) Appl. No.: 12/902,997

(22) Filed: Oct. 12, 2010

(65) Prior Publication Data

US 2012/0085552 A1 Apr. 12, 2012

(51) Int. Cl.
*E21B 19/02* (2006.01)
*E21B 33/04* (2006.01)

(52) U.S. Cl.
USPC ..... 166/382; 166/78.1; 166/85.5; 166/75.14

(58) Field of Classification Search
USPC ..... 166/78.1, 85.5, 85.1, 85.4, 84.1, 75.14, 166/382
See application file for complete search history.

(56) References Cited

U.S. PATENT DOCUMENTS

| | | | |
|---|---|---|---|
| 5,139,090 | A | 8/1992 | Land |
| 5,176,218 | A | 1/1993 | Singer et al. |
| 5,327,972 | A | 7/1994 | Theiss et al. |
| 5,327,975 | A | 7/1994 | Land |
| 5,383,519 | A | 1/1995 | Wright et al. |
| 5,388,639 | A | 2/1995 | Betchan et al. |
| 5,427,178 | A | 6/1995 | Bland |
| 5,429,188 | A | 7/1995 | Cameron et al. |
| 5,431,230 | A | 7/1995 | Land et al. |
| 5,465,788 | A | 11/1995 | Wright |
| 5,732,777 | A | 3/1998 | Grimshaw et al. |
| 5,771,969 | A | 6/1998 | Garay |
| 5,836,396 | A | 11/1998 | Norman |

(Continued)

FOREIGN PATENT DOCUMENTS

WO 9324727 12/1993

OTHER PUBLICATIONS

Baldor Motors and Drives, Success Stories, "Baldor Custom Gear Reducer Helps Reduce Oil Well Downtime," obtained from www.baldor.com, dated Apr. 28, 1998, 2 pgs.

(Continued)

*Primary Examiner* — William P Neuder
*Assistant Examiner* — Robert E Fuller
(74) *Attorney, Agent, or Firm* — Wong, Cabello, Lutsch, Rutherford & Brucculeri LLP

(57) ABSTRACT

A rotating breech lock rotates tubing to distribute wear caused by a rotating or reciprocating rod of an artificial lift system. The rotating breech lock has a spool that disposes on a wellhead. A bowl element disposes in the spool's bore, and a hanger fits into the spool and lands on the bowl element with a thrust bearing. Above the hanger, a load ring fits against the hanger with a bearing, and a hold-down sleeve and locking pins hold the load ring against the hanger. The spool has a worm that mates with a wheel defined about the hanger so turning the worm by a ratchet or other mechanism rotates the hanger. Internally, the hanger has a bore with opposing shoulders separated by gaps. A mandrel couples to the tubing and disposes up into the hanger. Protrusions or keys on the hanger can selectively align with the gaps and the shoulders depending on how the mandrel is rotated in the hanger bore.

32 Claims, 13 Drawing Sheets

(56) References Cited

U.S. PATENT DOCUMENTS

| | | | |
|---|---|---|---|
| 5,964,286 | A | 10/1999 | Cuppen |
| 6,026,898 | A | 2/2000 | Bland et al. |
| 6,095,241 | A | 8/2000 | Bland et al. |
| 6,199,630 | B1 | 3/2001 | Blundell et al. |
| 6,244,359 | B1 | 6/2001 | Bridges et al. |
| 6,543,533 | B2 | 4/2003 | Meek et al. |
| 6,640,892 | B1 | 11/2003 | Wright |
| 6,834,717 | B2 | 12/2004 | Bland |
| 7,306,031 | B2 | 12/2007 | Wright et al. |
| 2008/0035325 | A1 | 2/2008 | Ali-zada et al. |

OTHER PUBLICATIONS

Owen Oil Tools, "Technical Manual, Tubing Swivel TC-140-2375-000, TC-140-2875-000, TC-140-3125-000, MAN-TC 140," (c) 2006, 8 pgs.

R&M Energy Systems, "RODEC Tubing Rotator Systems," obtained from www.rmenergy.com, (c) 2005, 12 pgs.

R&M Energy Systems, "RODEC Tubing Rotator Systems," obtained from www.rmenergy.com, (c) 2010, 8 pgs.

Weatherford, Equipment Running Procedure, Section 17 "Installation of the WFT Breechlok Tubing Hanger, G-70 Seal Carrier and Tubing Head Adapter," (c) 2008, 15 pgs.

Kline Tools Oilfield Specialties, "Tubing Swivel," obtained from www.klinetools.com, dated Apr. 7, 2008, 1 pg.

R&M Energy Systems, "Tubing Wear Solutions," obtained from www.rmenergy.com, (c) 2010, 2 pgs.

Weatherford, "Breech-Lock Hanger System Enables Operator to Enhance Safety and Reduce Tubing Wear during Artificial Lift System Operations," obtained from weatherford.com, (c) 2009, 1 pg.

Weatherford, "Pumping Units: Reciprocating Rod-Lift Systems," obtained from weatherford.com, (c) 2005-2010, 20 pgs.

First Report in Australian Appl. 2011235930, Jul. 17, 2013.

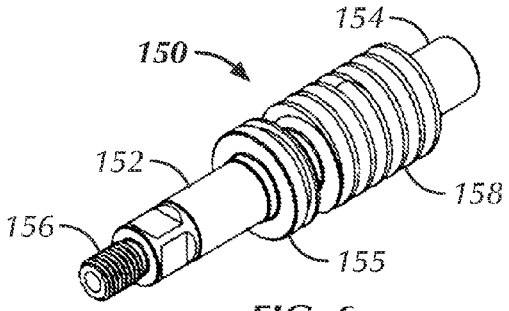
FIG. 6
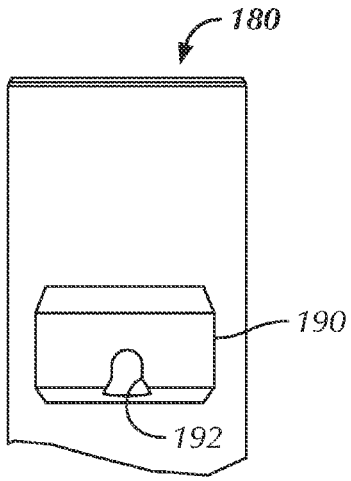
FIG. 7B
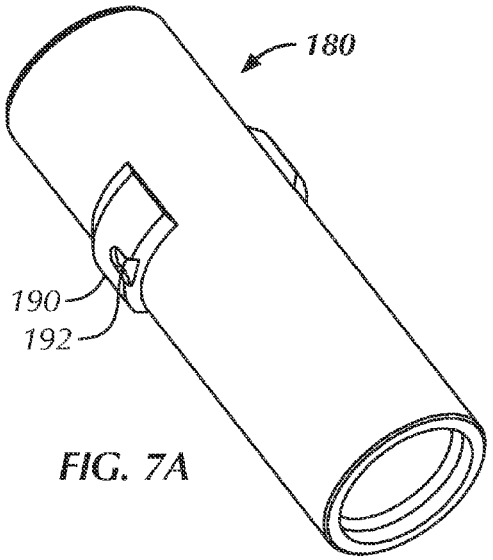
FIG. 7A
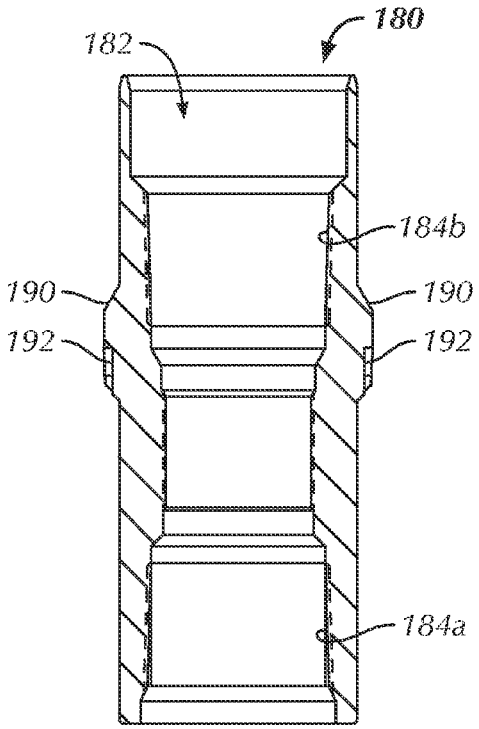
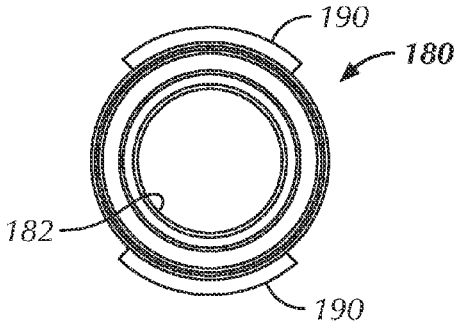
FIG. 7C
FIG. 7D

WELLHEAD ROTATING BREECH LOCK AND METHOD

BACKGROUND

Tubing hangers support tubing for wellheads in a number of applications. In general, most tubing hangers land in a tubing spool of the wellhead and support the weight of tubing that extends down the wellbore from the wellhead. One particular example of a tubing hanger is Weatherford's breech-lock tubing hanger system. This system has a false bowl and a hanger mandrel that land together in a tubing spool. Anchor screws retain the false bowl, while the hanger mandrel can be disengaged from the false bowl by lifting the mandrel in the false bowl with a landing joint and rotating the mandrel a quarter turn. In this orientation, the mandrel can be passed through the false bowl and can be run downhole. The mandrel can be reengaged in the false bowl with a reverse of these steps for placing tubing in tension.

Tubing hangers are also used for artificial lift systems. For example, a jack pump, a progressive cavity pump unit, or other device for an artificial lift system rotates or reciprocates a rod at a producing well. The rod operates downhole components of the artificial lift system to produce fluids from the wellbore. Because the moving rod passes through the wellhead and through tubing, the movement of the rod can cause excessive wear on internal portions of the tubing during operation. Additionally, the wellbore's deviation and the constituents of the produced fluids can increase the wear of the tubing. Eventually, the unevenly worn tubing can cause equipment failures so that it must be removed and replaced.

Tubing rotators are a type of tubing hanger that install on wellheads to deal with wear on the tubing by moving rods. Tubing swivels and tubing anchor catcher swivels have also been used in conjunction with tubing rotators. In general, the tubing rotator rotates the tubing within the wellbore so wear from the reciprocating or rotating rod can be more evenly distributed around the inside of the tubing. The rotation can also inhibit or reduce the buildup of paraffin or wax in the tubing.

Commercial examples of tubing rotators include the Rodec Tubing Rotator Systems available from R&M Energy Systems of Willis, Tex. Commercial examples of prior art tubing swivels include the Rodec Slimeline Tubing Swivel and Rodec AC Anchor Catcher Swivel available from R&M Energy Systems of Willis, Tex. Examples of some prior art tubing rotators and swivels are disclosed in U.S. Pat. Nos. 2,599,039; 2,471,198; 2,595,434; 2,630,181; 5,139,090; 5,327,975; and 5,427,178; and 6,834,717.

Attempts in the prior art to put tubing to be rotated under tension while using a tubing rotator have focused on aspects of the tubing anchor or swivel as disclosed in U.S. Pat. Nos. 5,139,090; 5,327,975; and 6,834,717, for example. Yet, there are limitations to current methods of setting tubing to be rotated by a "rotating tubing hanger" in tension while a blowout preventer (BOP) is installed on the well for complete well control. For example, when a rotating tubing hanger is to be used, operators run a tubing anchor in-the-hole on the bottom of the tubing string. The tubing is then spaced out to accommodate the rotating tubing hanger assembly, and operators set the anchor. With the anchor set, the tubing is stretched above the BOP (when applicable), which allows the rotating tubing hanger assembly to be installed on the tubing string. Once installed, the entire string is lowered through the BOP and landed in the wellhead. Performing these steps can be limited by the amount of stretch that can be applied to the tubing string so that this procedure may not work with some implementations.

Although existing tubing rotators and systems may be effective, what is needed is a way to rotate tubing that allows operators to pull tension on the tubing to be rotated during operation in a straightforward manner, especially when a blowout preventer (BOP) is installed on the well.

SUMMARY

A wellhead rotating breech lock rotates tubing to distribute wear evenly around the inside of the tubing caused by a rotating or reciprocating rod of an artificial lift system, for example. The rotating breech lock has a tubing spool that disposes on the wellhead. A hanger assembly has a bowl element that disposes in the spool's bore on a spool landing, and the bowl element supports a breech lock hanger in the spool with a thrust bearing. Above the hanger, a load ring fits against the hanger with a thrust bearing, and an adapter held in the spool with locking pins holds the load ring against the hanger.

The spool has a rotatable drive exposed in the spool's bore. The drive includes a worm that mates with a wheel defined around the outside of the breech lock hanger. Turning of the worm by a ratchet or other mechanism rotates the hanger. Internally, the hanger has a bore with opposing shoulders separated by gaps for selectively landing a mandrel.

The mandrel couples to tubing that disposes down the borehole from the wellhead. To engage the mandrel in the breech lock hanger, the mandrel disposes up into the hanger's bore, and landings on the mandrel can selectively land on the opposing shoulders in the hanger's bore. Therefore, to hold the mandrel in the hanger so it can turn with the hanger, the mandrel's landings can selectively align with the bore's shoulders when the mandrel is rotated in one orientation in the hanger bore. To insert or remove the mandrel from the hanger, the landings can selectively align with the gaps between shoulders when the mandrel is rotated in an offset orientation in the hanger bore.

The ability to engage and disengage the mandrel from the hanger with the landings and shoulders allows the mandrel and attached tubing to be keyed out of the hanger and run downhole to set downhole components, such as an anchor/packer assembly. With a downhole component set, the mandrel can be pulled back up into the hanger and keyed into a locked condition in the hanger so the mandrel and attached tubing can then rotate with the hanger during operation. In this way, tension can remain drawn on the tubing while the rotating breech lock subsequently rotates it during operation.

The foregoing summary is not intended to summarize each potential embodiment or every aspect of the present disclosure.

BRIEF DESCRIPTION OF THE DRAWINGS

FIG. 6 is a perspective view of a worm gear for the disclosed rotating breech lock.

FIGS. 7A-7D show perspective, elevational, end, and cross-sectional views of a mandrel for the disclosed rotating breech lock.

DETAILED DESCRIPTION

Figure 1A:
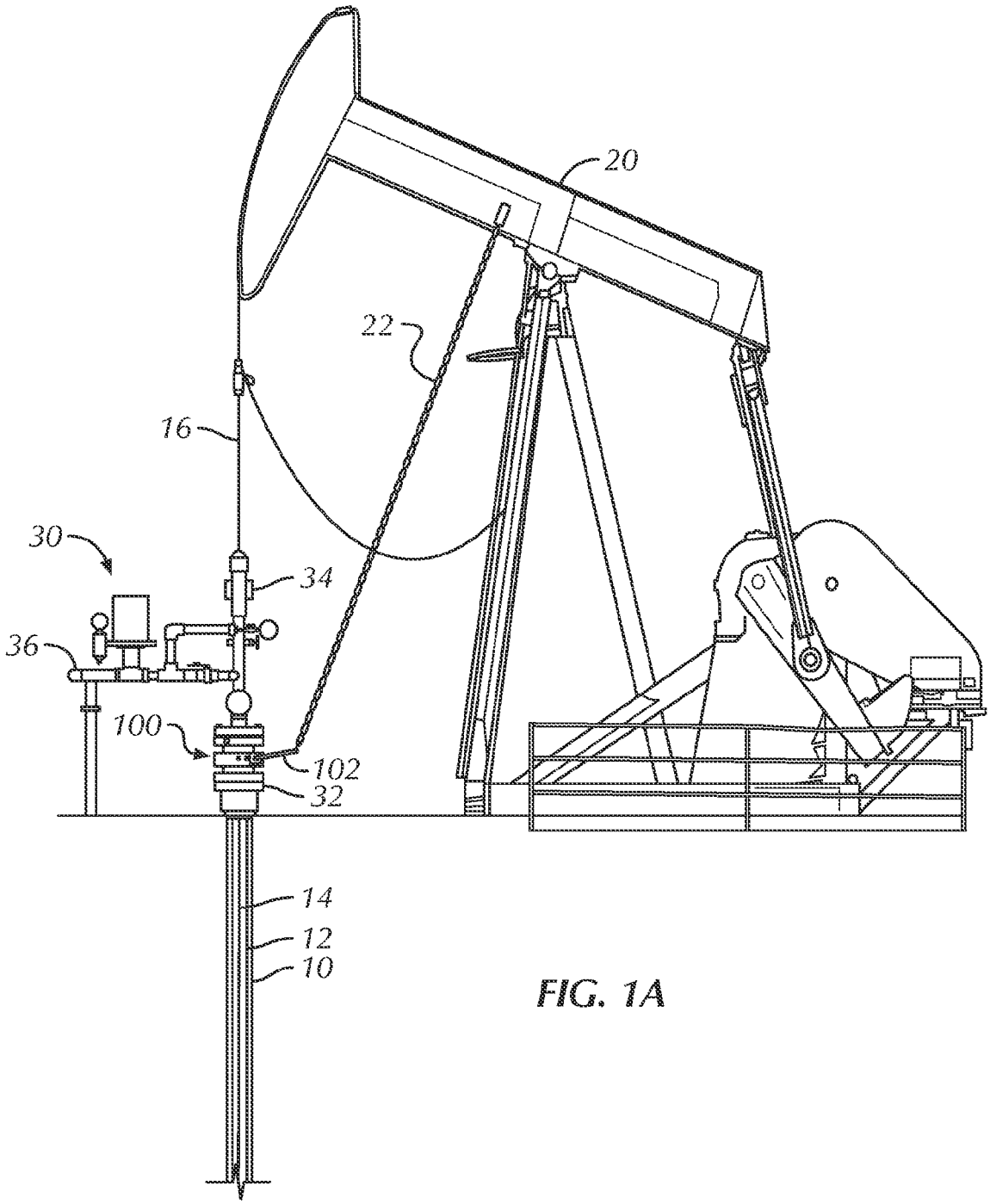
FIGS. 1A-1C illustrate a wellhead having a pump jack, a progressive cavity pump assembly, and a plunger lubricator in conjunction with a rotating breech lock according to the present disclosure.

As shown in FIG. 1A, a pump jack 20 reciprocates a sucker rod 14 though a wellhead assembly 30 of a borehole. Although shown with the pump jack 20, any suitable pumping unit can be used, such as a StrapJack® pumping unit, Rotaflex® pumping unit, or other type of pumping unit. (STRAP JACK and ROTAFLEX are registered trademarks of Weatherford/Lamb, Inc.) The wellhead assembly 30 has a wellhead or casing head 32 supporting casing 10 in the borehole. Typically, the wellhead 32 has a casing hanger (not shown) disposed therein that supports the casing 10, which is cemented in the borehole. Below the wellhead assembly 30, tubing 12 disposed in the casing 10 has the sucker rod 14 disposed therein. Above the wellhead 32, the assembly 30 has a stuffing box 34 and piping 36 for collecting production fluid.

The sucker rod 14 extending downhole can have several sections of rod (not shown) interconnected by rod couplings (not shown). At its downhole end, the sucker rod 14 connects to a downhole plunger and barrel arrangement (not shown) in a producing zone of the borehole. At the surface, however, the sucker rod 14 couples to a polished rod 16 that passes through the wellhead assembly 30 and seals through the stuffing box 34. The upper end of the rod 16 then couples to the pump jack 20.

As the pump jack 20 operates, the sucker rod 14 and polished rod 16 reciprocate through the wellhead assembly 30 and tubing 12 to operate the downhole pump and bring production fluid to the surface. As noted previously, the reciprocating rod 14 can cause excessive and uneven wear inside the tubing 12. By rotating the tubing 12 while the pump jack 20 is operating, the inside surface of the tubing 12 can be worn evenly, which extends the tubing's life.

To achieve this rotation, the wellhead assembly 30 includes a rotating breech lock 100 according to the present disclosure. The rotating breech lock 100 installs above the wellhead 32 and supports the tubing 12 in the borehole. As the pump jack 20 operates, an interconnecting chain 22 pulls a lever 102 of a ratchet or similar mechanism coupled to the rotating breech lock 100. With the cyclical motion of the pump jack 20, the rotating breech lock 100 can then rotate the tubing 12 by some defined amount (e.g., several degrees). In this way, wear inside the tubing 12 caused by the reciprocating rod 14 can be more evenly distributed around the tubing's internal circumference. In addition to rotating the tubing 12, the rotating breech lock 100 of the present disclosure allows the tubing 12 to be pulled in tension as described in more detail later.

Figure 1B:
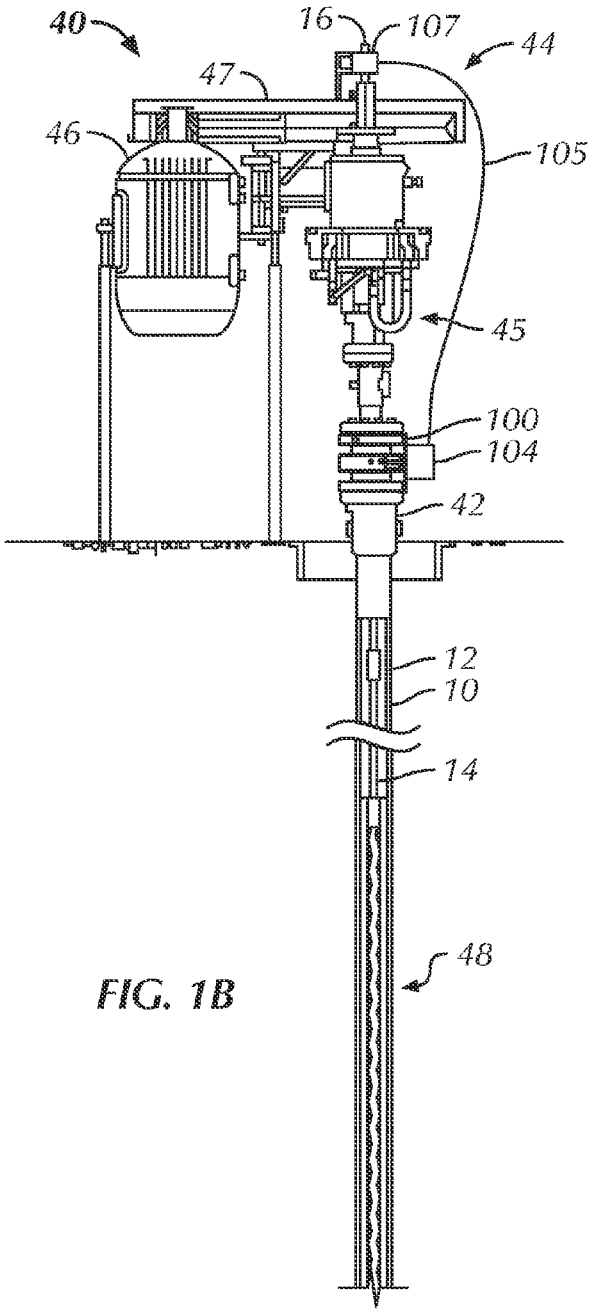

In FIG. 1B, another implementation has the disclosed rotating breech lock 100 for rotating tubing 12 extending from a wellhead assembly 40. In this arrangement, the wellhead assembly 40 has a wellhead 42 disposed above casing 10. The rotating breech lock 100 disposes on the wellhead 42 and supports the tubing 12 in the borehole. Above the rotating breech lock 100, the wellhead assembly 40 has a stuffing box 45, a motor 46, and other components of a progressive cavity pump drive 44.

Here, the rod 14 rotates by the drive 44 at the wellhead assembly 40 and rotates a rotor in a stator of a downhole progressive cavity pump 48 deployed downhole. To rotate the rod 14, a polished rod 16 at the surface passes through the stuffing box 45. The motor 46 attached by a gear assembly 47 rotates the rods 14/16 to operate the downhole pump 48.

As the motor 46 operates, the rod 14 rotates in the tubing 12, which can cause excessive and uneven wear inside the tubing 12. By rotating the tubing 12 with the rotating breech lock 100 while the motor 46 is operating, the inside surface of the tubing 12 can be worn evenly, which extends its life. To achieve this rotation, a flexible drive cable 105 extends from an upper gear box 107 to another gear box 104. As the polished rod 16 turns, the flexible drive cable 105 transfers the rotation of the rod 16 from the one gear box 107 to the other gear box 104, which is coupled to the rotating breech lock 100. With the rotation of the rod 16, the rotating breech lock 100 can then rotate the tubing 12 so that the sucker rod 14 extending through the tubing 12 causes more even wear inside.

Figure 1C:
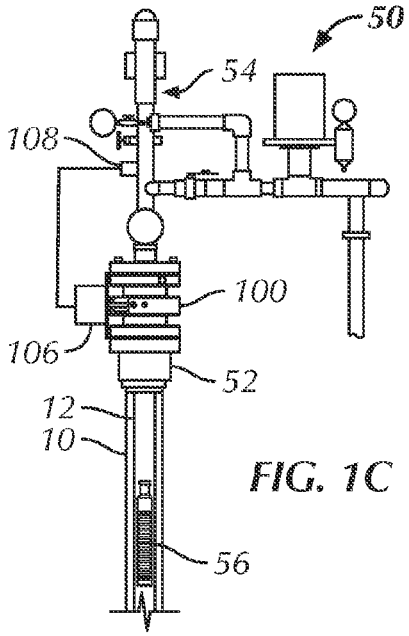

As opposed to the above mechanisms for mechanically activating the rotating breech lock 100, another implementation shown in FIG. 1C can use an electrically controlled drive 106 coupled to the rotating breech lock 100 on a plunger lift system 50. During operation, the controlled drive 106 activates the rotating breech lock 100 to rotate the tubing 12 to distribute wear. This drive 106 can be electrical, hydraulic, or pneumatic and can have control circuitry and other necessary components.

As also shown in FIG. 1C, the disclosed rotating breech lock 100 can be used in applications other than those involving a rotating or reciprocating rod. As shown here, the disclosed rotating breech lock 100 is used with a plunger lift system 50 in which a plunger 56 travels uphole and downhole through tubing 12 in a borehole casing 10. At the surface, a lubricator 54 has a bumper, catcher, piping and other components for the plunger 56. A sensor 108, such as a proximity sensor or the like, can detect or count the plunger 56 when it arrives at the lubricator 54, and the drive 106 can use the sensed detection to operate the rotating breech lock 100 to rotate the supported tubing 12. Again, the ability to rotate the tubing 12 with the rotating breech lock 100 in this type of system can also reduce wear caused by the repeated passage of the plunger 56.

For even distribution of wear, the tubing 12 in FIGS. 1A-1C is preferably turned automatically on a continuous basis. As indicated above, the rotating breech lock 100 can be activated in a number of ways including movement by a pump jack, a flexible drive cable, an electronically controlled drive, hydraulic pressure, etc. As will be appreciated with the benefit of this disclosure, these and other mechanisms can be used to actuate the rotating breech lock 100. Moreover, the rotating breech lock 100 can be used with systems having reciprocating rod, rotating rod, a plunger lift, and other systems in applications where rotating tubing can be advantageous.

Figure 2A:
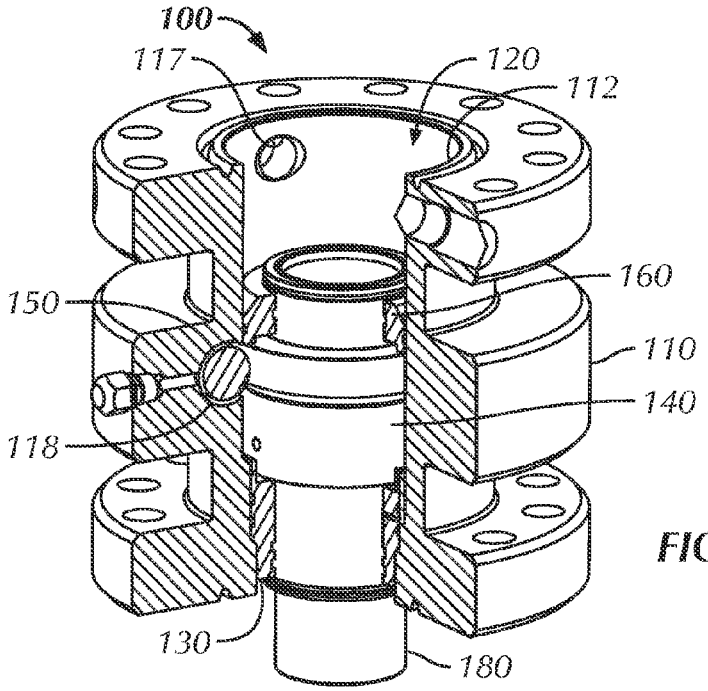
FIG. 2A is a cutaway perspective view showing components of the disclosed rotating breech lock.
Figure 2B:
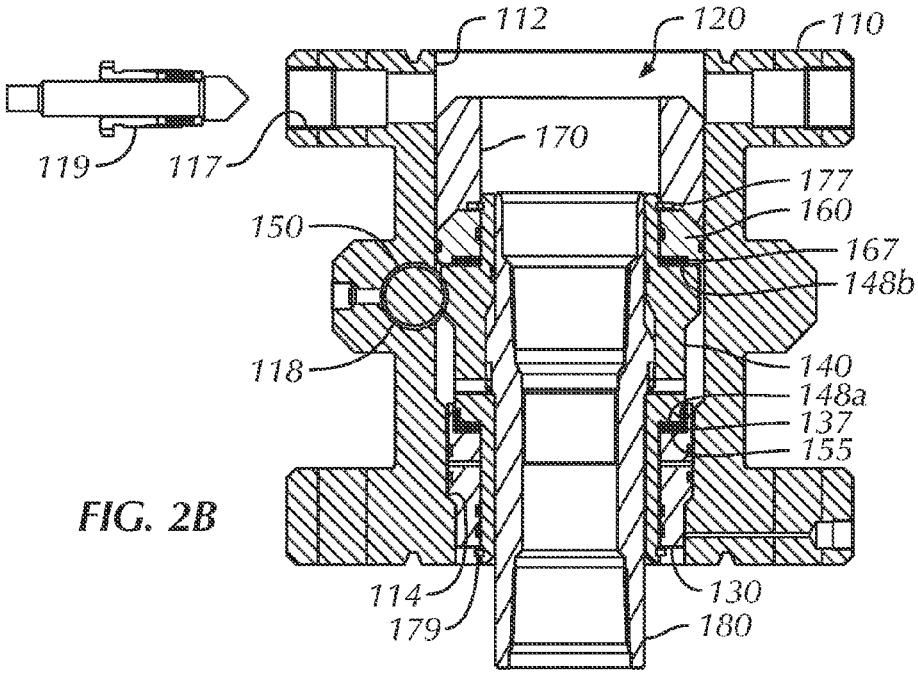
FIG. 2B is a cross-sectional view showing components of the disclosed rotating breech lock.

With an understanding of how the disclosed rotating breech lock 100 is used, discussion now turns to a more detailed description of the rotating breech lock's components and operation. FIG. 2A shows portions of the rotating breech lock 100 in a cutaway perspective, and FIG. 2B shows portions of the rotating breech lock 100 in cross-section. The rotating breech lock 100 includes a tubing spool 110 and a hanger assembly 120. The tubing spool 110 has a drive 150, and the hanger assembly 120 has an intermediate bowl 130, a rotating breech hanger 140, a load ring 160, a load ring adapter 170, and a mandrel 180.

As shown, the intermediate bowl 130 lands in the spool's bore 112 against a lower landing 114, and the bowl 130 has a number of external seals to seal in the bore 112. The rotating breech hanger 140 has a bearing shoulder 148*a* that lands on the bowl's bearing shoulder 135 with a thrust bearing 137 disposed therebetween. Portion of the rotating breech hanger 140 seals inside the bore 132 of the intermediate bowl 130. The thrust bearing 137 can use roller bearings or other types of bearings, and lubrication ports 115*a* can be provided in the spool 110 for lubricating the bearing 137. The intermediate bowl 130 affixes to the rotating breech hanger 140 with a snap ring, spiral lock, or the type of retainer 179, and the bowl 130 has ports for delivering lubrication to the bearing 137.

Figure 3A:
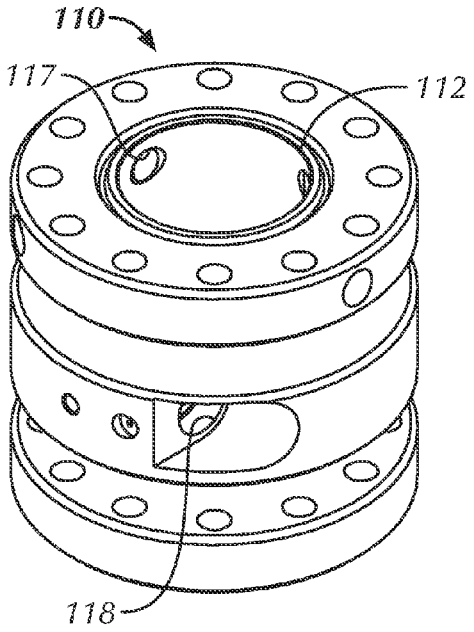
FIGS. 3A-3C show perspective, cross-sectional, and end-sectional views of a tubing spool for the disclosed rotating breech lock.
Figure 3B:
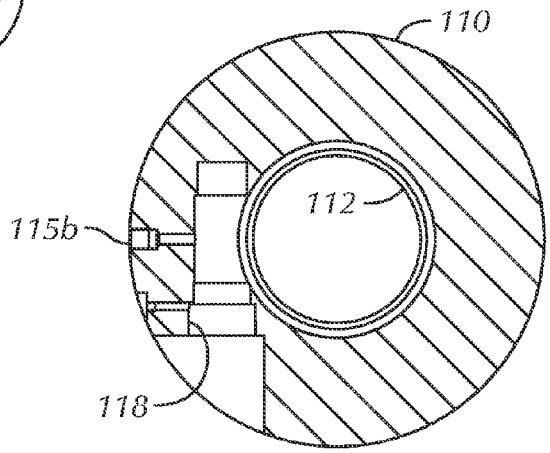
Figure 3C:
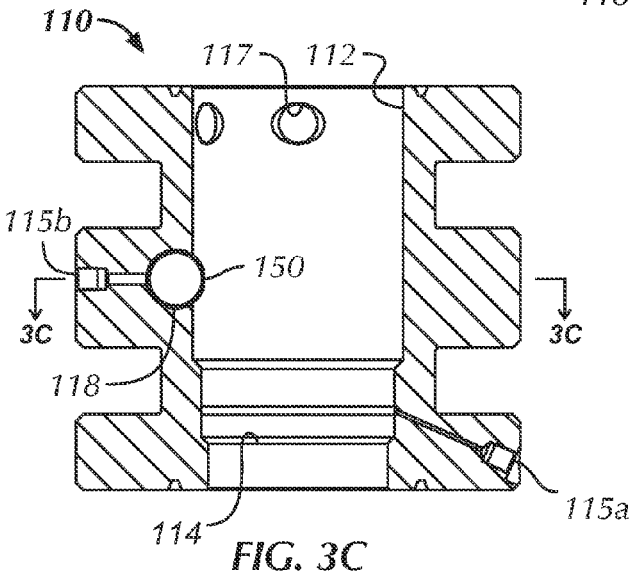
Figure 4A:
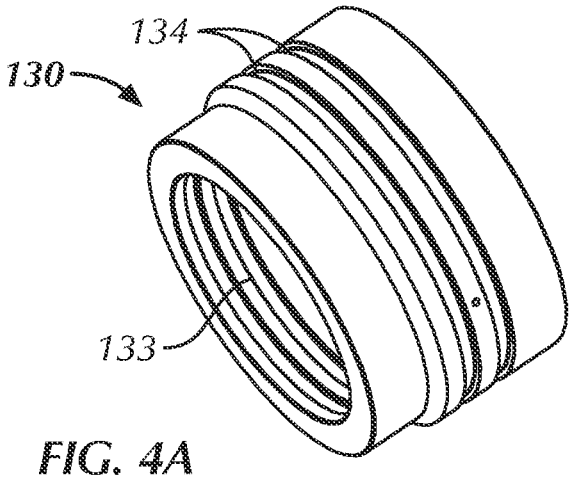
FIGS. 4A-4B show perspective and cross-sectional views of an intermediate bowl for the disclosed rotating breech lock.
Figure 4B:
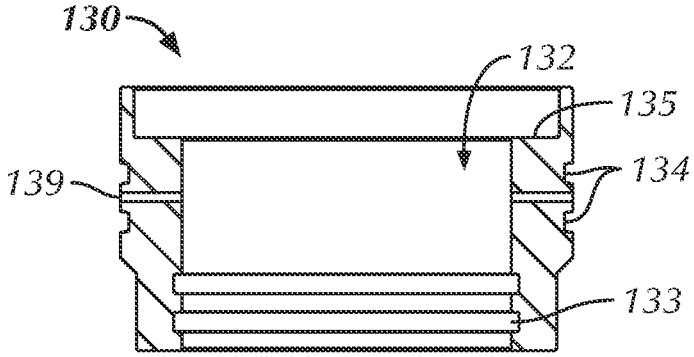

Shown in isolated detail in FIGS. 3A-3C, for example, the tubing spool 110 defines a lubrication port 115*a* and an annular groove arrangement to bring lubricant into the spool's bore 112. Another lubrication port 115*b* communicates with the side hole 118 for the worm drive (150). Shown in detail in FIGS. 4A-4B, the intermediate bowl 130 has inner slots 133 and outer slots 134 for O-rings and defines side ports 139 for communicating lubrication.

Returning to FIGS. 2A-2B, the load ring 160 lands on an upper shoulder 148*b* of the rotating breech hanger 140 with a thrust bearing 167 and seals against the spool's bore 112 and the breech hanger 140 with O-ring seals. Again, the thrust bearing 167 can use roller bearings or other types of bearings, and lubrication can be provided to the bearing 167 via the lubricator port (115*b*) of the spool (110) for the drive (150) or some other pathway.

Figure 8A:
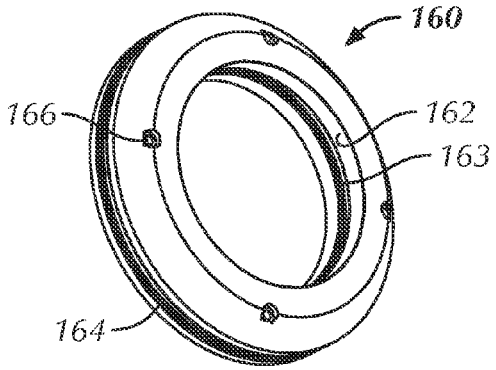
FIGS. 8A-8B show perspective and cross-sectional views of a load ring for the disclosed rotating breech lock.
Figure 8B:
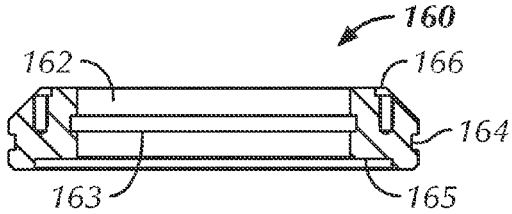

Shown in detail in FIGS. 8A-8B, for example, the load ring 160 has a load bearing shoulder 165 for fitting against the thrust bearing (167). In addition, the load ring 160 has a slot 163 in the bore 162 for an O-ring seal (not shown). At its upper end, the ring 160 has thread holes 166 to receive ends of bolts (not shown) for attaching the load ring 160 to the load ring adapter (170) as discussed below.

Figure 9A:
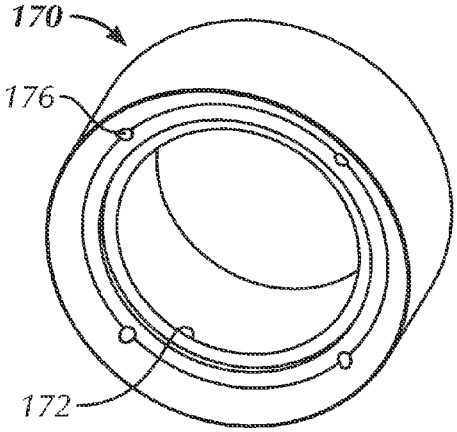
FIGS. 9A-9B show perspective and cross-sectional views of a load ring adapter for the disclosed rotating breech lock.
Figure 9B:
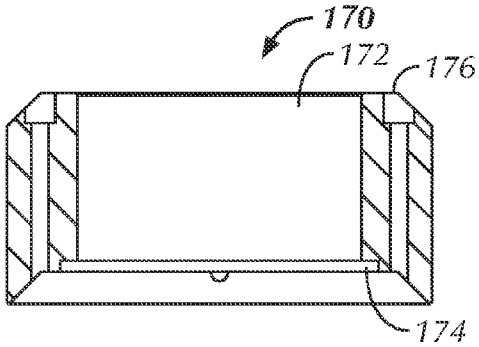

As shown in FIG. 2B, the load ring adapter 170 fits above the load ring 160 and can be held by lock pins 119 installing in pin holes 117 in the spool's upper flange. A snap ring 177 fits between the adapter 170 and the load ring 160, and the snap ring 177 engages a top groove on the rotating breech hanger 140 to couple these components together. In this way, the adapter 170, the load ring 160, the rotating breech hanger 140, and the intermediate bowl 130 can all be lowered into the spool 110 as a unit and landed on the spool's shoulder 114. Shown in detail in FIGS. 9A-9B, the adapter 170 has holes 176 for passage of the bolts (not shown) used to attach the adapter 170 to the load ring (160).

Finally, as shown in FIGS. 2A-2B, the mandrel 180 is shown installed in the rotating breech hanger 140, where it can be selectively landed. The upper end of the mandrel 180 can seal inside the breech's bore 142. The mandrel 180 as discussed below installs into the breech's bore 142 from the lower end, and the bore 142 of the breech hanger 140 prevents upward passage of the mandrel 180.

With an understanding of the arrangement of components for the disclosed rotating breech lock 100 and how they install together, discussion now turns to more details related to the rotating breech hanger 140, the drive 150, and the mandrel 180.

As shown in FIGS. 5A-5D, the bore 142 of the rotating breech hanger 140 has a widened area 144, and the bore 142 has lands 146 separated by slot gaps 147 defined in the lower end thereof. The bore's widened area 144 accommodates portions of the mandrel (180) when disposed therein, and the lands 146 and gaps 147 enable the mandrel (180) to selectively land in (or pass out of) the hanger's bore 142 depending on how the mandrel (180) is oriented.

Figure 5A:
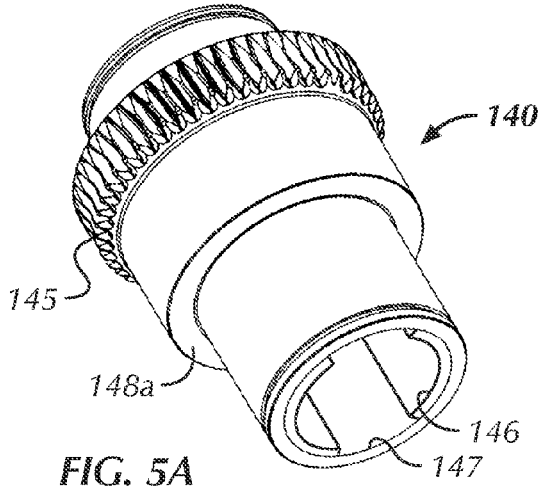
FIGS. 5A-5D show perspective, elevational, cross-sectional, and end-sectional views of a rotating breech hanger for the disclosed rotating breech lock.
Figure 5B:
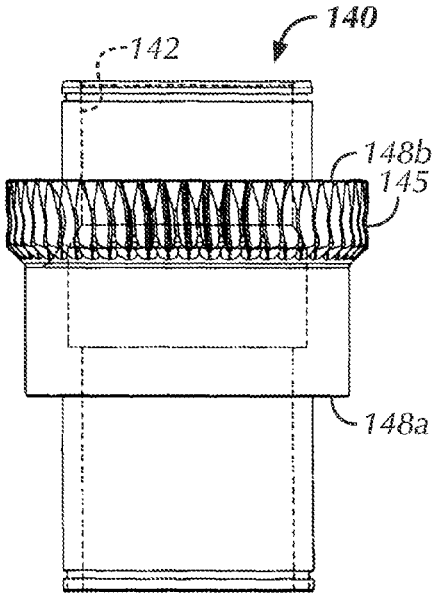
Figure 5C:
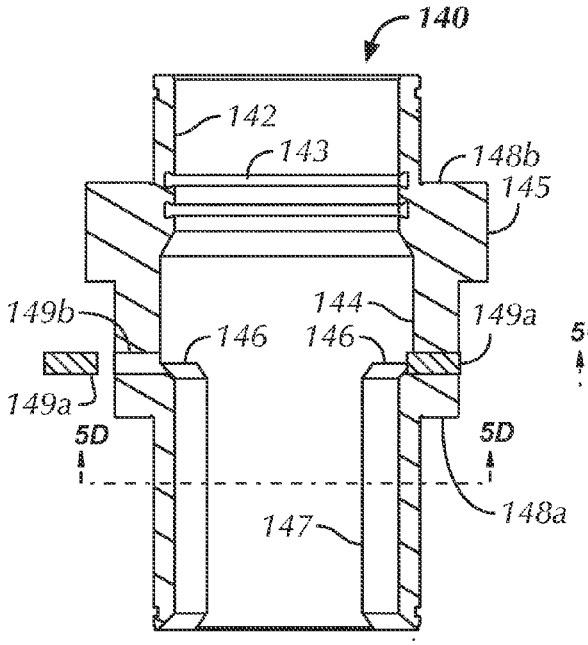
Figure 5D:
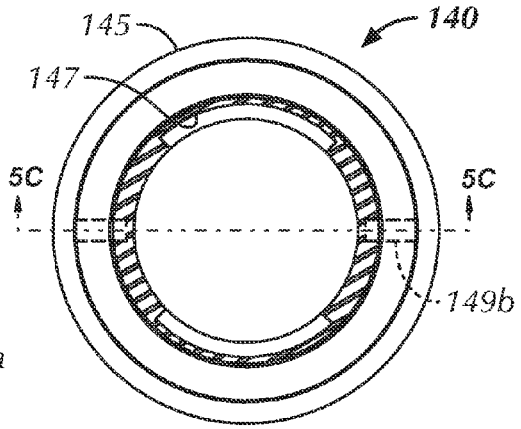

As best shown in FIG. 5C, grooves 143 at the upper end hold O-ring seals (not shown) for engaging the mandrel (180) when disposed in the bore 142. Holes 149*b* defined through the breech hanger 140 communicate with the bore 142 at the lands 146. These holes 149*b* receive pins 149*a* for engaging the mandrel (180) as described below. As best shown in FIGS. 5A-5B, an increased outer diameter of the breech hanger 140 defines a worm wheel 145 thereabout, which is used for turning the hanger 140 as discussed below.

As noted previously with reference to FIGS. 2A-2B, the rotating breech hanger 140 lands inside the spool 110 equipped with the drive 150, and the mandrel 180 coupled to the downhole tubing fits up into the bore 142 of the breech hanger 140. As the rod cycles up and down or rotates, for example, the motion cycles the rotation of the breech hanger 140 via the drive 150. The rotation of the breech hanger 140 in turn rotates the tubing attached to the mandrel 180 and reduces wear inside the tubing to increase the tubing's life.

Various types of drive mechanisms can be used for the drive 150 that rotates the hanger 140 in the spool's bore 112. For example, the drive 150 can use any of a number of gear arrangements known in the art. As shown more particularly in FIG. 6, the drive 150 has a shaft 152 with thread of a worm 158 disposed thereabout. The shaft's distal end 154 fits into the inner pocket of the spool's side hole (118; FIG. 3C), while the shaft's proximal end 156 protrudes therefrom for threading to other components, such as handle, motor, lever, ratchet, or the like, used to rotate the worm 158. A rim 155 between the worm 158 and the proximal end 156 holds a seal for sealing in the spool's side hole (118).

The worm 158 of the drive 150 meshes with the wheel 145 defined about the breech hanger 140 of FIGS. 5A-5B. The worm 158 and wheel 145 allow the breech hanger 140 to drift into place in the tubing spool (110) with sufficient clearance while the worm 158 and wheel 145 mesh during assembly. The meshing preferably avoids any attempt of the components' teeth to chew against one another. To accomplish this, the profile on the wheel 145 as shown in FIGS. 5A-5B preferably has a curved side profile and has inlet fillets to ease the gear around the elements of the worm 158 as the wheel 145 drifts into place.

As noted previously with reference to FIGS. 2A-2B, the mandrel 180 fits up into the bore 142 of the hanger 140. In particular, the mandrel 180 shown in detail in FIGS. 7A-7D has landings 190 on opposing sides of the mandrel's outside surface. Each of these landings 190 defines a key slot 192. Inside, the mandrel's bore 182 has threads 184*a*-*b* for coupling to tubing (not shown) as described below.

As will be evident later, the rotating breech hanger (140; FIGS. 5A-5D) can rotate the mandrel 180 and tubing when the mandrel 180 is installed in a seated orientation inside the rotating breech hanger (140). When installed in this seated orientation within the breech hanger (140; FIG. 5C), for example, the landings 190 on the mandrel 180 can land on the landing shoulders (146) inside the hanger's bore (142). In this position, the key slots 192 can align with the side holes (149*b*)

in the breech hanger 140. The pins (149*a*) in the side holes (149*b*) can then engage in the mandrel's key slots 192 to lock rotation of the mandrel 180 and breech hanger (140) together. These pins (149*a*) can be held with an interference fit in the holes (149*b*) or by other means.

When the mandrel 180 is lifted and rotated to an offset orientation situated 90-degrees from its seated orientation, the mandrel's landings 190 can pass along the slots (147) on the inside of the bore (142) of the breech hanger (140; FIG. 5C). With this orientation, the mandrel 180 can pass out of and draw into the breech hanger (140). Being able to move the mandrel 180 in and out of the rotating breech hanger (140) allows tubing attached to the mandrel 180 to be drawn up into the breech hanger (140) in tension.

Figure 10:
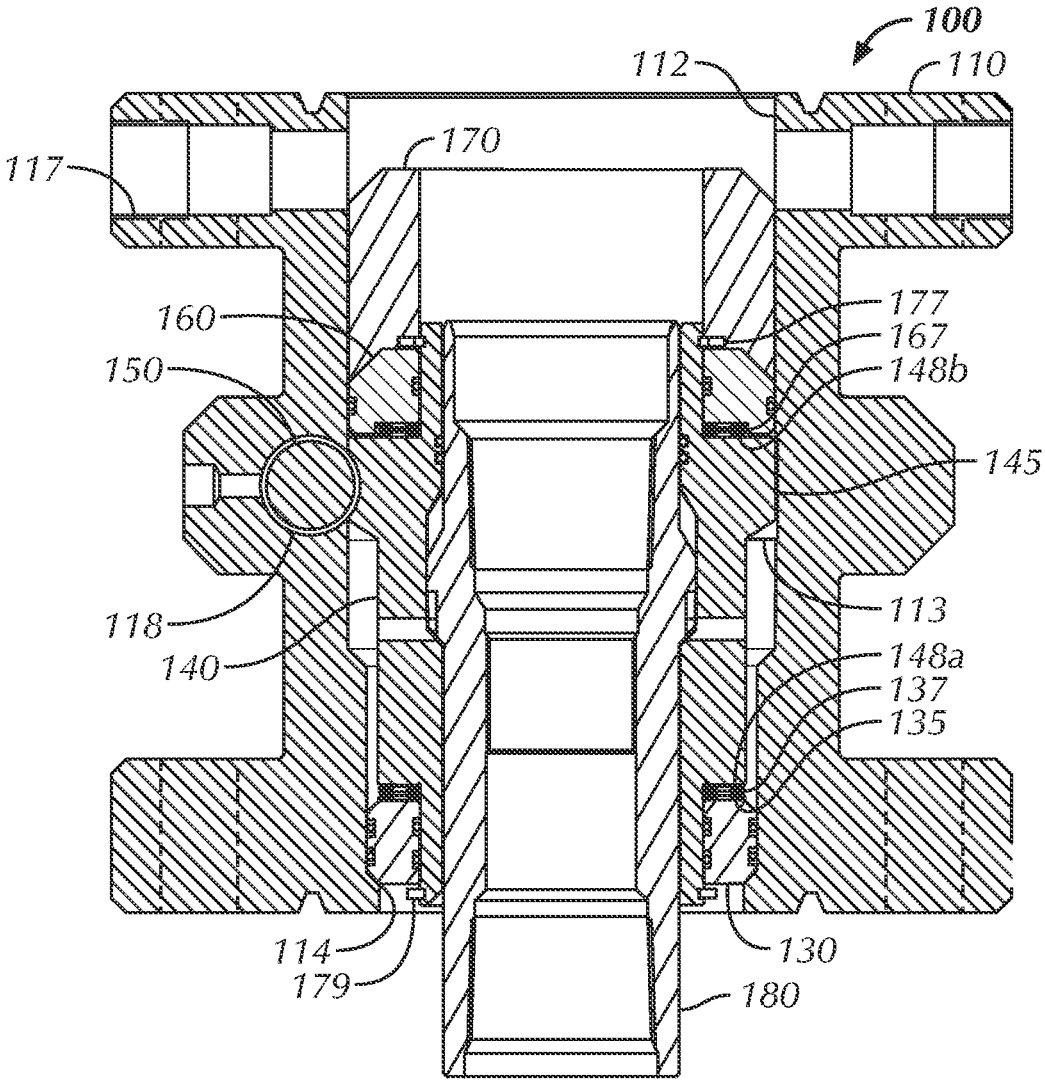
FIG. 10 is a cross-sectional view showing components of another rotating breech lock according to the present disclosure.

FIG. 10 is a cross-sectional view showing components of another arrangement for the rotating breech lock 100 of the present disclosure. Components of this rotating breech lock 100 are similar to those described previously so that like reference numerals are used between similar components. In FIG. 10, however, the intermediate bowl 130 has a more compact shape, and the tubing spool 110 has a shoulder 114 disposed lower in the spool's bore 112. As before, the intermediate bowl 130 affixes to the breech hanger 140 on the lower end with a snap ring, a spiral lock, or the type of retainer 179. This bowl 130 can have lubrication ports (not shown) communicating with ports (not shown) on the spool 110 so the bearings 137 can be lubricated in a manner similar to that described previously. As also shown, the internal bore 112 of the spool 110 can define a recess 113 to accommodate the worm wheel 145 and reduce the chances that friction between the bore 112 and wheel 145 may occur.

The use of the more compact intermediate bowl 130 can reduce problems with wear, friction, and stresses and can allow the rotating breech hanger 140 to have increased width along its length, which can be beneficial. Overall, the rest of the rotating breech lock 100 can be the same as described previously and can function in the same way.

Figure 11A:
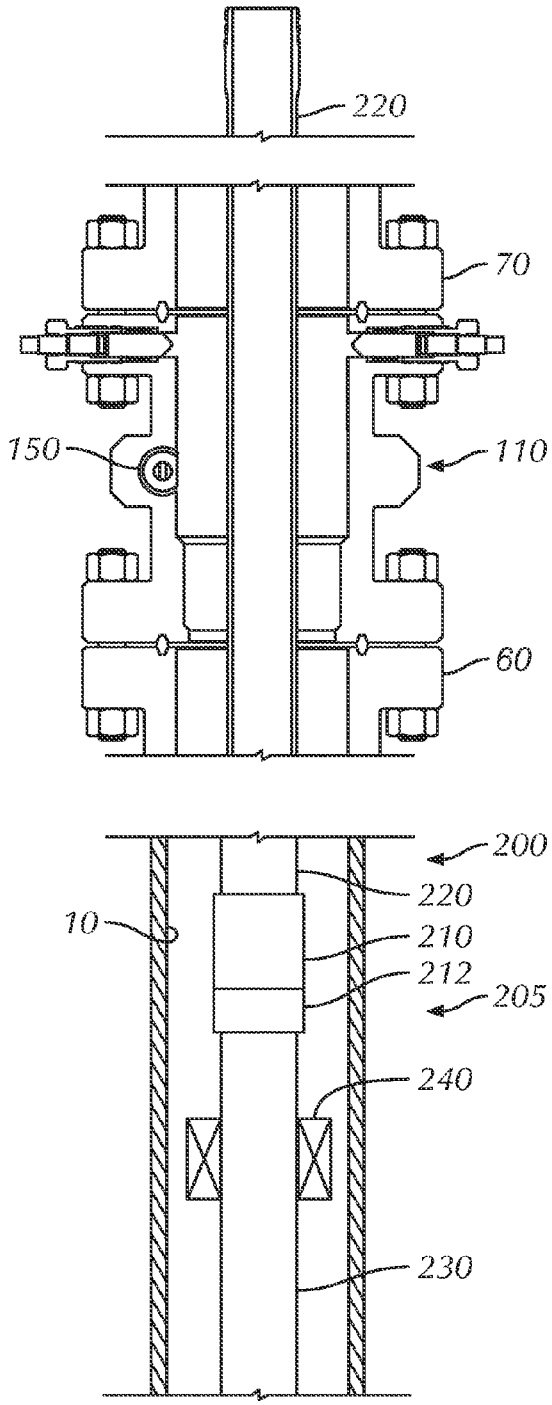
FIGS. 11A-11E show installation and operation of a rotating breech lock of the present disclosure at a wellhead.

Assembly and operation of the rotating breech lock 100 will now be discussed with reference to FIGS. 11A-11E. As shown in FIG. 11A, the tubing spool 110 equipped with the drive 150 installs on wellhead components 60 according to standard procedures. A BOP stack 70 then installs above the tubing spool 110 using standard procedures to provide wellbore isolation during assembly. Operators can then attach any ratchet lever or other assembly (not shown) to the drive 150.

At this point, operators measure the distance from the rig floor to the gear boss surrounding the tubing spool 110 for the drive 150. This distance is used later when setting up additional components of the rotating breech lock 100. Operators run a tubing string 200 having tubing (e.g., 220/230) and having an anchor/packer assembly 205 downhole according to standard procedures. Which components of the anchor/packer assembly 205 used on the tubing string 200 depends on the implementation (e.g., whether a reciprocating, rotating, or plunger type of system is used). As shown, the anchor/packer assembly 205 can have an anchor 210 and a swivel 212 between tubing 220/230 and can have a packer 240 as well as other elements.

Downhole, for example, the distal end of upper tubing 220 can have an anchor 210 with a tubing swivel 212. For its part, the tubing swivel 212 can use a known design having bearings and seals that can operate in both compression and tension to allow the tubing 220 above the swivel 212 to rotate while tubing 230 and other components downhole from the swivel 212 do not rotate. The anchor 210 can also have components of an anchor catch swivel, such as slips and the like, known in the art.

Figure 11B:
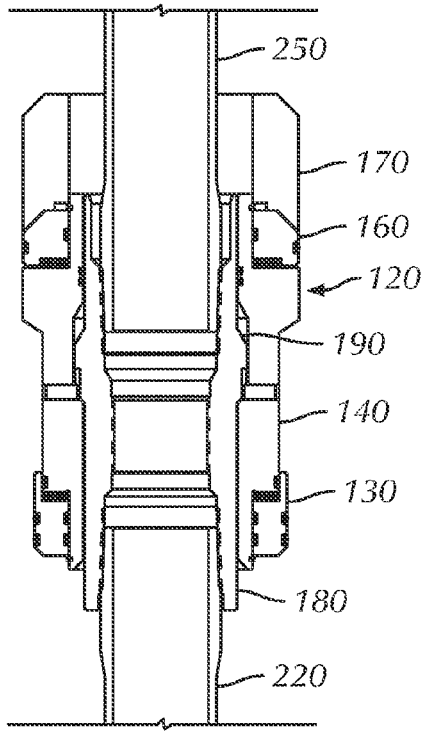

At the rig, operators run the tubing string 200 downhole and then set it in place with slips so that the top of the upper tubing 220 is at a suitable level above the rig floor (not shown) for installing the hanger assembly 120. As shown in FIG. 11B, operators then assemble components of the hanger assembly 120 together by making up the intermediate bowl 130, the breech hanger 140, the load ring 160, and the adapter 170 to one another as described previously. To do this, the bowl 130 affixes on the hanger 140 with the ring 179 and has the thrust bearing 137 against the hanger 140. The load ring 160 fits on the other end of the hanger 140 with the thrust bearing 167, and the ring 177 affixes the load ring 160 to the hanger 140. The adapter 170 then fits onto the hanger 140 and secures to the load ring 160 with screws (not shown).

With the hanger assembly 120 made up, operators make up the mandrel 180 on the tubing string 200 and thread it to required torque as shown in FIG. 11B. Operators then orient the made-up hanger assembly 120 with the adapter 170 upwards and slide the assembly 120 over the top of the mandrel 180. To do this, the mandrel 180 fits through the lower end of the rotating breech hanger 140 with the mandrel's landings 190 passing through the hanger's slots (147; FIG. 5C). Once the landing shoulder 190 of the mandrel 180 is located in the relief area (144; FIG. 5C) in the rotating breech hanger 140, operators rotate the hanger assembly 120 clockwise 90° (¼ turn) and allow the assembly 120 to rest on the mandrel 180.

As shown in FIG. 11B, a landing joint 250 then makes up to the top of the mandrel 180 using standard procedures. Marks are made on the landing joint 250 aligned with the landing shoulders 190 of the mandrel 180 to indicate their orientation. Additionally, marks are made on the rig floor aligned with the mandrel's landing shoulders 190 to indicate their orientation.

Figure 11C:
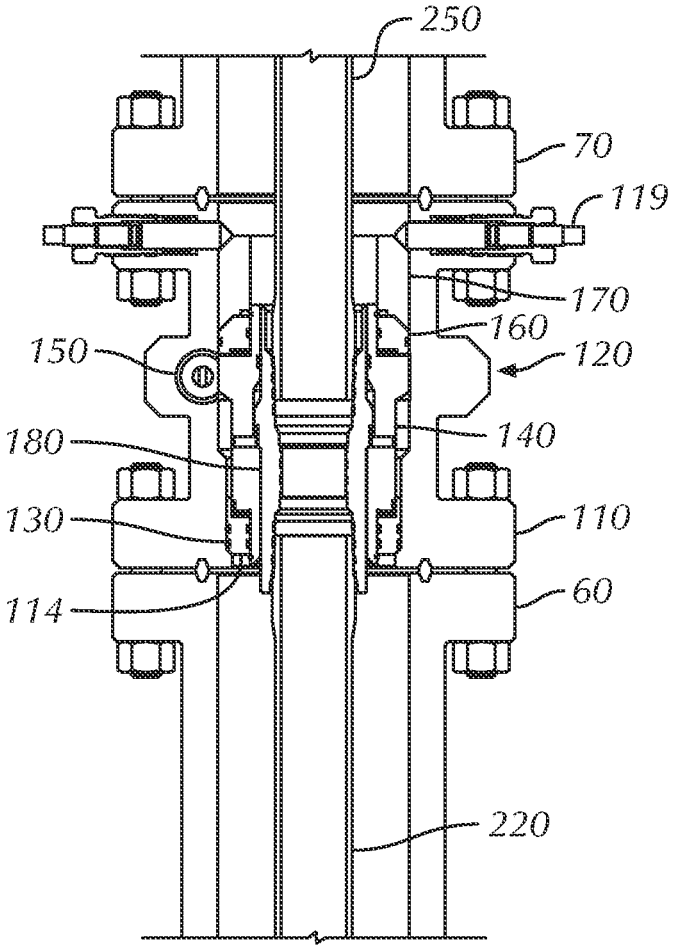
Figure 11C:
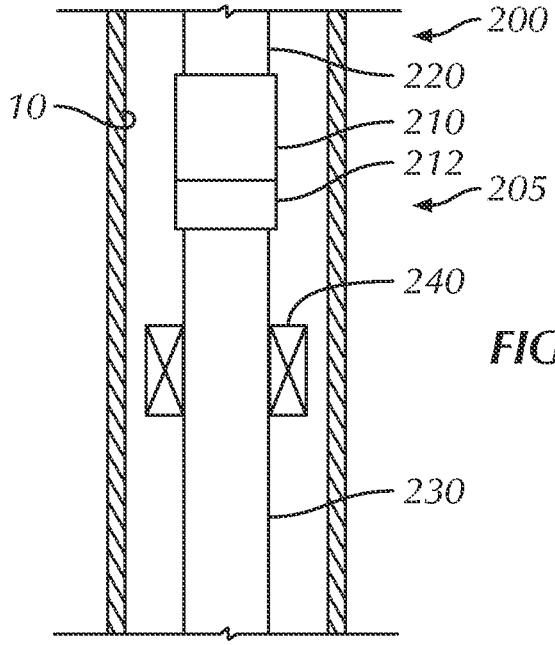

At this point, operators lower the hanger assembly 120 in the tubing spool 110. As shown in FIG. 11C, the intermediate bowl 130, the breech hanger 140, the load components 160/170, the mandrel 180, and attached tubing 220 are run though the spool's bore 112 until the intermediate bowl 130 lands on the spool's landing shoulder 114. When properly landed, a horizontal mark made previously on the landing joint 250 should be level with the rig floor. Once landed, operators install and tighten all of the anchor screws 119 to retain the hanger assembly 120 in the spool 110. With the hanger assembly 120 landed inside the tubing spool 110, operators then make a mark on the landing joint 250 above the rig floor at a specified distance for the tubing string 200 to be lowered to set the packer/anchor assembly downhole as described below.

Figure 11D:
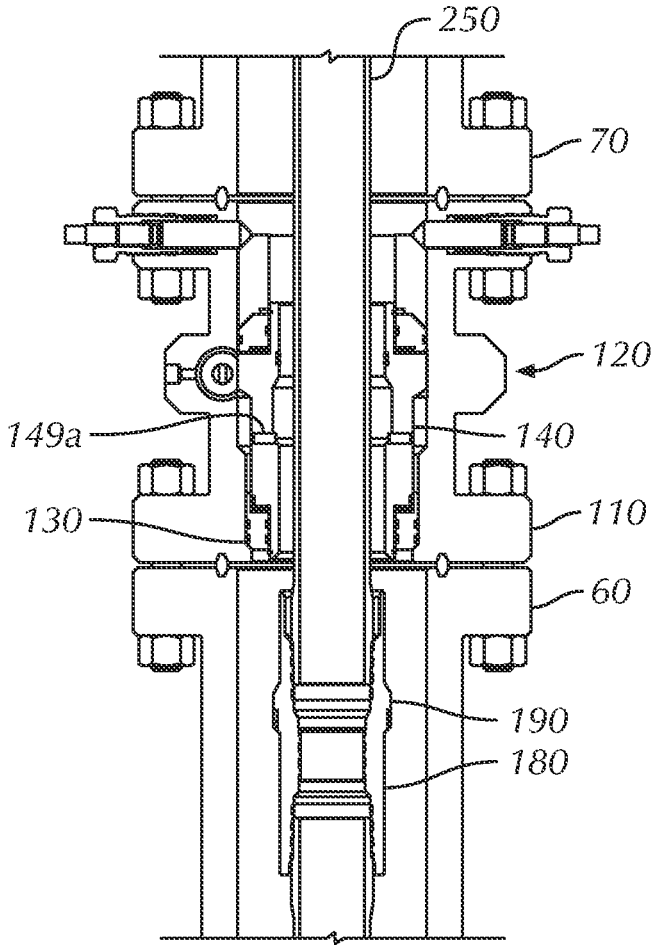
Figure 11D:
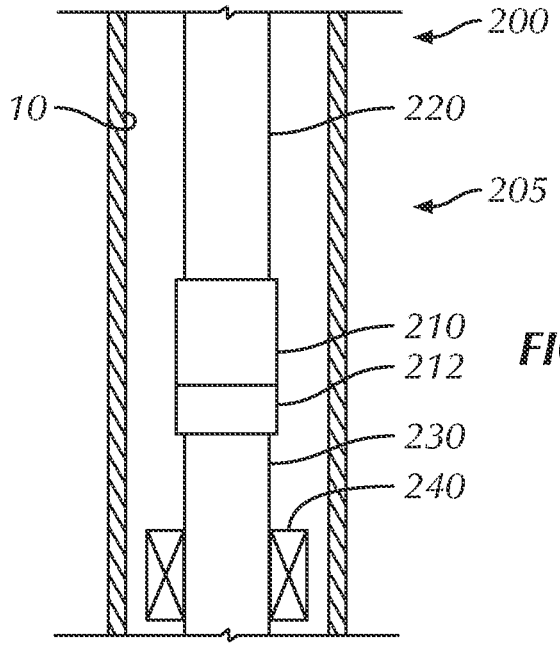

At this point, operators disengage the mandrel 180 from the breech hanger 140 as shown in FIG. 11D. To do this, operators lift the landing joint 250 and the mandrel 180 until all of the tubing weight is taken off the hanger 140. This moves the landings 190 free of the pins 149*a*. Using the previous vertical markings, operators then rotate the mandrel 180 a quarter turn (i.e., 90-degrees) so the landings 190 align with the landing gaps (147; FIG. 5C) in the hanger's bore 142.

Once the mandrel 180 has been keyed free, operators then run the mandrel 180 downward through the breech hanger 140, intermediate bowl 130, and beyond as shown in FIG. 11D. The tubing string 200 is run until reaching the mark on the landing joint 250 specifying the required distance to set the anchor/packer assembly 205 downhole. Operators then actuate the anchor/packer assembly 205 using known procedures. For example, the tubing swivel 210 can have J-slot locking mechanisms, slips, and other components related to tubing swivels and tubing anchors known and used in the art to make the necessary connection. For its part, the packer 240 can be set mechanically and/or hydraulically.

Figure 11E:
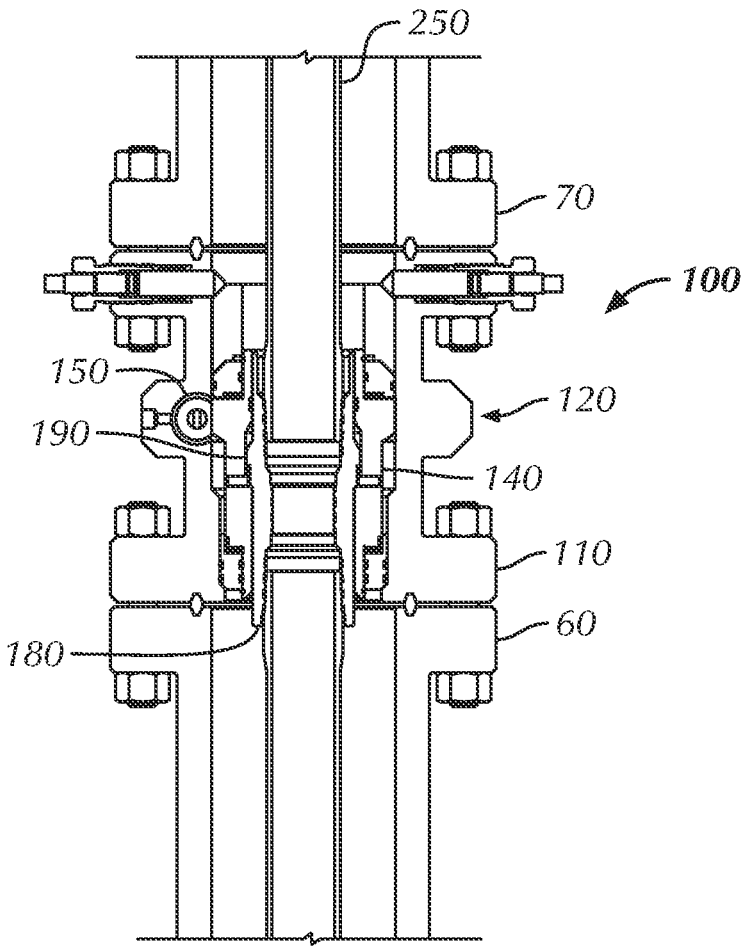
Figure 11E:
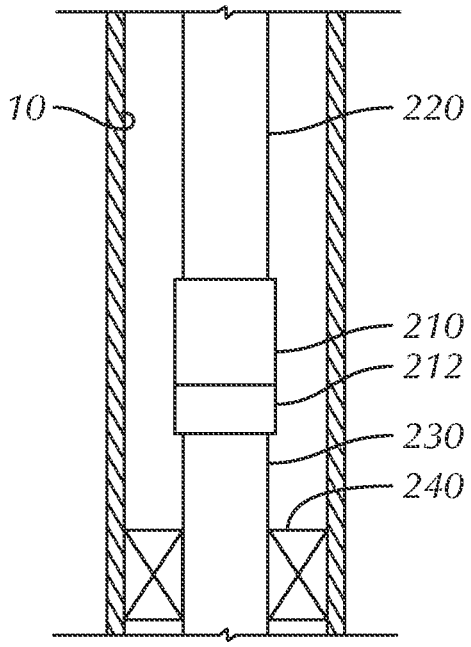

At this point with the tubing string 200 properly set, operators align the vertical marks on the landing joint 250 with the marks on the rig floor to align the mandrel's landings 190 with the hanger's gaps (147; FIG. 5C). The tubing swivel 212 can allow the upper tubing 220 to rotate relative to the tubing 230 set with the packer 240. With a straight vertical lift, operators then pull the mandrel 180 attached to the tubing 220 back upward into the rotating breech hanger 140 as shown in FIG. 11E. This puts tension on the tubing 220. The mandrel 180 can pilot itself back into the breech hanger 140 if aligned within an acceptable accuracy. If the weight indicator shows a sudden increase, however, operators can slack off and realign the mandrel's shoulders 190.

Once the mandrel 180 reaches the upper recess (144; FIG. 5C) inside the hanger's bore (142), operators rotate the mandrel 180 a quarter turn. The swivel 210 can allow the mandrel 180 and attached tubing 220 to turn relative to the fixed tubing 230 and other components downhole. Once turned, operators lower the mandrel 180 and key it back into the breech hanger 140 as shown in FIG. 11E. At this point, the hanger assembly 120 has the tubing's tension on it.

Operators can remove the landing joint 250 by rotating it counter-clockwise from the mandrel 180. With the well safe and under control, the BOP stack 70 is removed from the tubing spool 110. Now the rotating breech lock 100 is set up for operation, and operators can install any other components, such as ratchet mechanism, production piping, gas lift equipment, rod, etc. The tubing 220 is now ready to be rotated via the drive 150 of the rotating breech lock 100 with tension pulled on the tubing 220.

All the while, the hanger assembly 120 maintains pressure containment between the mandrel 180 and the breech hanger 140 while rotating the tubing 220 in conjunction with a pump jack or other actuating device. As the device cycles and the action rotates the breech hanger 140, internal wear on the tubing's internal diameter can be evenly distributed to increase the life of the tubing 220 and decrease the need for maintenance. Downhole, the swivel 212 allows the tubing 220 to rotate relative to production tubing 230 and other components fixed in the wellbore's casing 10. Whenever a work over is needed, a landing joint 220 can stab into the mandrel 180 so previous procedures can be used to disengage the mandrel 180 from the breech hanger 140.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wellhead rotating breech lock, comprising:

a spool disposed on a wellhead and defining a spool bore with a drive exposed therein;

a hanger having uphole and downhole ends, the hanger landing in the spool bore and defining a hanger bore with a first selective landing, the hanger rotating in the spool bore with activation of the drive; and a mandrel coupling to tubing and positioning at least partially in the hanger bore, the mandrel having a second selective landing, the second selective landing engaging with the first selective landing when the mandrel positions in a first orientation in the hanger bore and disengaging from the first selective landing when the mandrel positions in a second orientation in the hanger bore, wherein the mandrel in the second orientation is passable into and out of the hanger bore through the downhole end of the hanger.

2. The breech lock of claim 1, wherein the hanger comprises a bowl element positioning in the spool bore, the bowl element landing on a spool landing in the spool bore and supporting the hanger thereon.

3. The breech lock of claim 2, wherein the hanger comprises a first bearing shoulder, and wherein the bowl element comprises a second bearing shoulder supporting the first bearing shoulder with a bearing.

4. The breech lock of claim 1, wherein the hanger comprises a lock down element holding the hanger in the spool bore.

5. The breech lock of claim 4, wherein the lock down element comprises a load ring positioning against the hanger with a bearing.

6. The breech lock of claim 4, wherein locking pins on the spool hold the lock down element in the spool bore.

7. The breech lock of claim 1, wherein the first selective landing of the hanger comprises shoulders disposed on sides of the hanger bore and separated by gaps, and wherein the second selective landing of the mandrel comprises protrusions disposed on sides of the mandrel.

8. The breech lock of claim 7, wherein the protrusions align with the shoulders when the mandrel positions in the first orientation within the hanger bore, and wherein the protrusions align with the gaps when the mandrel positions in the second orientation within the hanger bore, the protrusions being passable through the gaps and out the downhole end of the hanger.

9. The breech lock of claim 8, wherein the protrusions each define a key slot, and wherein the hanger comprises keys disposed in the hanger bore adjacent the shoulders, the keys engaging the key slots in the protrusions and preventing rotation of the mandrel relative to the hanger when engaged therein.

10. The breech lock of claim 9, wherein the mandrel lifts a distance in the hanger to disengage the key slots from the keys, and wherein the lifted mandrel rotates in the hanger to align the protrusions with the gaps for passing through the downhole end of the hanger.

11. The breech lock of claim 1, wherein the drive comprises a rotatable worm exposed in the spool bore, and wherein the hanger comprises a wheel mating with the rotatable worm, the hanger rotating with rotation of the rotatable worm.

12. The breech lock of claim 1, further comprising a mechanism coupling to the drive and rotating the hanger with the drive when activated.

13. The breech lock of claim 1, further comprising pump equipment moving in the tubing, wherein the drive rotates the hanger based on motion of the pump equipment.

14. The breech lock of claim 13, wherein the pump equipment comprises a pump jack coupled to a rod and to the drive, wherein reciprocating motion of the pump jack reciprocates the rod in the tubing and activates the drive.

15. The breech lock of claim 13, wherein the pump equipment comprises a progressive cavity pump drive coupled to a rod and to the drive, and wherein rotating motion of the progressive cavity pump drive rotates the rod in the tubing and activates the drive.

16. The breech lock of claim 13, wherein the pump equipment comprises a plunger moving in the tubing to and from the wellhead, and wherein motion of the plunger actuates the drive.

17. The breech lock of claim 1, further comprising a tubing swivel disposed on the tubing, the tubing swivel isolating the rotation of the tubing from additional tubing disposed downhole from the tubing swivel.

18. A wellhead artificial lift system, comprising:

a spool disposed on a wellhead, the spool defining a spool bore and having a worm exposed in the spool bore;

a hanger having uphole and downhole ends, the hanger supported in the spool bore and defining a hanger bore therethough, the hanger bore defining a first selective landing, the hanger having a wheel disposed thereabout, the wheel mating with the worm, the hanger being rotatable in the spool with rotation of the worm;

a mandrel coupling to tubing for passing through the wellhead, the mandrel at least partially positioning in the hanger bore and having a second selective landing thereon, the mandrel disposed in the hanger bore being movable to selectively engage and disengage the second selective landing of the mandrel with the first selective landing of the hanger, wherein the mandrel in a disengaged condition is passable into and out of the hanger bore through the downhole end of the hanger; and pump equipment coupled to the wellhead, the worm rotating the hanger based on motion of the pump equipment.

19. The system of claim 18, wherein the first selective landing of the hanger comprises shoulders disposed on sides of the hanger bore and separated by gaps, and wherein the second selective landing of the mandrel comprises protrusions disposed on sides of the mandrel.

20. The system of claim 19, wherein the protrusions align with the shoulders when the mandrel positions in the first orientation within the hanger bore, and wherein the protrusions align with the gaps when the mandrel position in the second orientation within the hanger bore, the protrusions being passable through the gaps and out the downhole end of the hanger.

21. The system of claim 20, wherein the protrusions each define a key slot, and wherein the hanger comprises keys disposed in the hanger bore adjacent the shoulders, the keys engaging the key slots in the protrusions and preventing rotation of the mandrel relative to the hanger when engaged therein.

22. The system of claim 21, wherein the mandrel lifts a distance in the hanger to disengage the key slots from the keys, and wherein the lifted mandrel rotates in the hanger to align the protrusions with the gaps for passing through the downhole end of the hanger.

23. A method of rotating tubing at a wellhead, comprising;

landing a hanger in a spool of a wellhead, the hanger defining a hanger bowl and having uphole and downhole and ends;

anchoring tubing to components disposed downhole from the wellhead;

pulling tension on the tubing by pulling a mandrel attached to the tubing at least partially into the hanger bore through the downhole end of the hanger;

supporting the tubing in the wellbore with the mandrel and the hanger by landing a second selective landing of the mandrel on a first selective landing in the hanger bore of the hanger; and intermittently rotating the tubing by rotating the hanger with a drive exposed in the spool along with the landed mandrel coupled to the tubing.

24. The method of claim 23, wherein landing the hanger in the spool comprises landing the hanger with the mandrel disposed therein, the mandrel having the tubing extending therefrom.

25. The method of claim 24, wherein anchoring the tubing to the components disposed downhole from the wellhead comprises disengaging the mandrel from the hanger bore, passing the mandrel through the downhole end of the hanger, and running the mandrel and the tubing downhole.

26. The method of claim 25, wherein disengaging the mandrel from the hanger bore comprises pulling the second selective landing on the mandrel off the first selective landing in the hanger bore and aligning the second selective landing with a slot in the hanger bore by rotating the mandrel in the hanger bore.

27. The method of claim 23, wherein anchoring the tubing to the components disposed downhole from the wellhead comprises setting an anchor and a packer downhole from a tubing swivel on the tubing.

28. The method of claim 23, wherein pulling the mandrel at least partially into the hanger bore through the downhole end of the hanger comprises aligning the second selective landing on the mandrel with slots in the hanger bore, and passing the second selective landing in the slots when pulling the mandrel through the downhloe end of the hanger.

29. The method of claim 28, wherein landing the mandrel in the hanger bore comprises rotating the mandrel and the tubing and aligning the second selective landing with the first selective landing in the hanger bore.

30. The method of claim 23, wherein rotating the hanger in the spool comprises activating the drive exposed in a spool bore of the spool and rotating the hanger in the spool bore with the activation of the drive.

31. The method of claim 30, wherein activating the drive comprises rotating a worm mating with a wheel on the hanger.

32. The method of claim 30, wherein activating the drive comprises using motion of pump equipment to activate the drive.

* * * * *